United States Patent [19]

Roth

[11] 4,406,382

[45] Sep. 27, 1983

[54] EMPTY BEVERAGE CONTAINER SIGNALING SYSTEM

[75] Inventor: Allen R. Roth, High Ridge, Mo.

[73] Assignee: Multiplex Company, Inc., St. Louis, Mo.

[21] Appl. No.: 225,512

[22] Filed: Jan. 15, 1981

[51] Int. Cl.[3] ..... B67D 5/08

[52] U.S. Cl. ..... 222/64; 222/61; 222/23; 340/606; 340/604; 137/551

[58] Field of Search ..... 137/141, 213, 551; 222/64, 52, 61, 23; 340/373, 603, 604, 606, 608

[56] References Cited

U.S. PATENT DOCUMENTS

| | | | |
|---|---|---|---|
| 2,127,875 | 8/1938 | Lippert et al. | 201/48 |
| 2,138,677 | 11/1938 | Meyer | 201/48 |
| 2,182,195 | 12/1934 | Bornstein | 201/48 |
| 2,483,967 | 10/1949 | Eberwine | 73/304 |
| 2,552,088 | 5/1951 | Davis | 340/604 |
| 2,798,215 | 7/1957 | Domingo et al. | 340/606 |
| 3,445,834 | 5/1969 | Street et al. | 340/236 |
| 3,898,637 | 8/1975 | Wolstenholme | 340/606 |
| 4,143,793 | 3/1979 | McMillin et al. | 222/64 X |

*Primary Examiner*—Joseph J. Rolla
*Assistant Examiner*—Jan Koniarek
*Attorney, Agent, or Firm*—Senniger, Powers, Leavitt and Roedel

[57] ABSTRACT

A system for signaling emptying of a beverage storage container of a beverage dispensing system before any substantial amount of gas enters the delivery line between the container and a dispensing valve. No signal system components are in the container; instead, a fitting is mounted in the delivery line adjacent the container with two electrodes spaced from and electrically insulated from one another within the fitting for contact with the beverage. Sensing circuitry determines whether beverage bridges the two electrodes and causes signaling on non-bridging of the two electrodes by beverage in the line to indicate that the container is empty.

5 Claims, 4 Drawing Figures

EMPTY BEVERAGE CONTAINER SIGNALING SYSTEM

BACKGROUND OF THE INVENTION

The present invention relates to beverage dispensing systems, and more particularly to apparatus for signaling the depletion of beverage from a beverage container.

The invention is concerned with the problem of signaling to an attendant, such as a bartender dispensing beer from a tap, that a storage container, such as a keg of beer, is empty before a relatively long delivery line from the container to the tap has also become depleted of the beverage. If all or a significant portion of the line becomes void of beverage and thereby fills with gas (e.g., air or carbon dioxide), dispensing of the beverage may be difficult when a new full container is connected to the delivery line to replace the empty container. For example, when carbonated beverages are being dispensed, a large concentrated mass of carbon dioxide in the line causes severe foaming at the dispensing valve.

Prior apparatus has incorporated signal system components within the storage containers to sense the level of liquid in the container. Transferring these components from an empty container to a new full container is timeconsuming and difficult. Providing permanently mounted components in each container is expensive. Complex level detecting apparatus is not required for the simpler task of signaling only the total depletion of beverage from the container.

U.S. Pat. Nos. 2,127,875, 2,138,677, 2,182,195 and 2,483,967 are relevant to the field of signaling the level of a beverage in a container.

SUMMARY OF THE INVENTION

Among the several objects of this invention may be noted the provision of an improved system for signaling emptying of a beverage container of a beverage dispensing system wherein the beverage is dispensed from the container through a delivery line connected at one end to the container and having a dispensing valve at its other end; the provision of such a signaling system adapted to signal the emptying of the container without any signal system components in the container; the provision of such a signaling system which signals the emptying of the container before any substantial length of the delivery line becomes void of beverage and filled with gas; the provision of such a signaling system which is readily installed; the provision of such a signaling system in which the sensing components need not be disconnected when replacing an empty container; and the provision of such a signaling system capable of monitoring several containers simultaneously.

Briefly, the invention involves a system for signaling emptying of a beverage container of a beverage dispensing system wherein the beverage is dispensed from the container through a relatively long delivery line, the line being connected at one end to the container and having a dispensing valve at its other end at a location relatively remote from the container. Beverage in the container is under pressure for delivery when the valve is opened. The signaling system, which is without any signal system components in the container, is adapted to signal the emptying of the container before any substantial amount of gas (air, carbon dioxide) enters the delivery line from the empty container. The signaling system comprises a fitting for mounting in the line adjacent the container. The fitting has a passage for flow of beverage therethrough, with two electrodes spaced one from the other in the passage for contact with beverage in the passage, the electrodes being electrically insulated from each other. Sensing circuitry detemines whether beverage bridges the two electrodes in the fitting. Means responsive to the sensing circuitry signals non-bridging of the two electrodes by beverage in the passage to signal emptying of the container before any substantial amount of gas enters the delivery line from the empty container.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
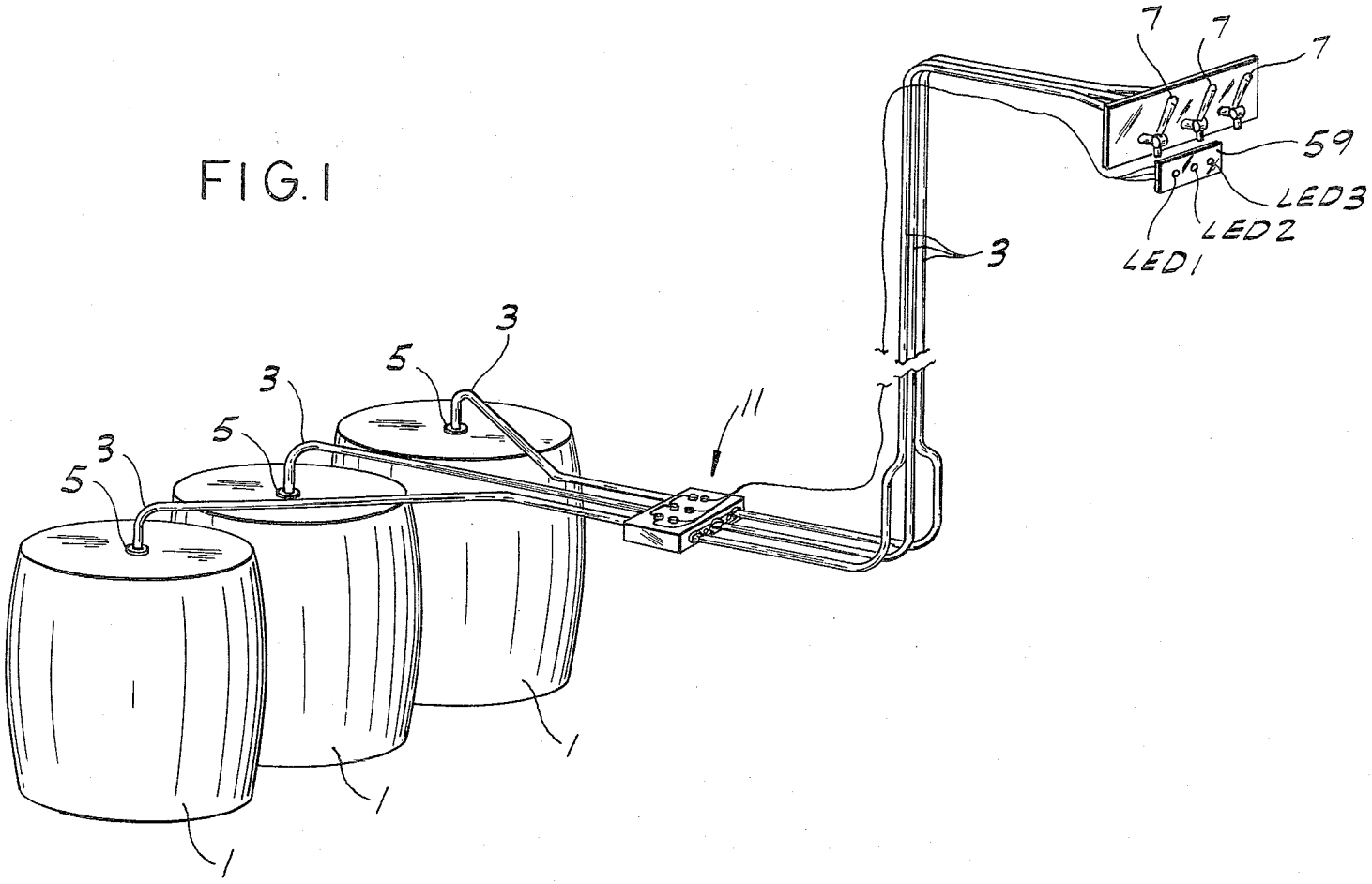
FIG. 1 is a perspective showing an empty beverage container signaling system embodying the present invention including a sensor body installed in the delivery lines of a typical beverage dispensing system.

Referring to FIG. 1 of the drawings, there is shown a sysem of this invention for signaling emptying of beverage containers 1, such as kegs of beer, in a typical beverage dispensing system. In the system shown, the beverage is dispensed from the containers through delivery lines 3, such as of flexible plastic tubing. Quick disconnect couplings 5 are provided in the delivery lines at the containers; the couplings 5 disconnect without admitting air into the delivery lines. The delivery lines connect to dispensing valves 7, such as beer taps, at the other end of the line. The dispensing valves are often at a location remote from the container and hence the delivery lines are often relatively long, perhaps twenty–thirty feet. The beverage in the container is under pressure for delivery when the valve is opened. If a carbonated beverage is dispensed, pressure is supplied by the carbon dioxide in the beverage. For non-carbonated beverages, the container is pressurized by compressed air. The pressure maintains the line normally full of beverage (under pressure) so that beverage may be instantly dispensed.

Figure 2:
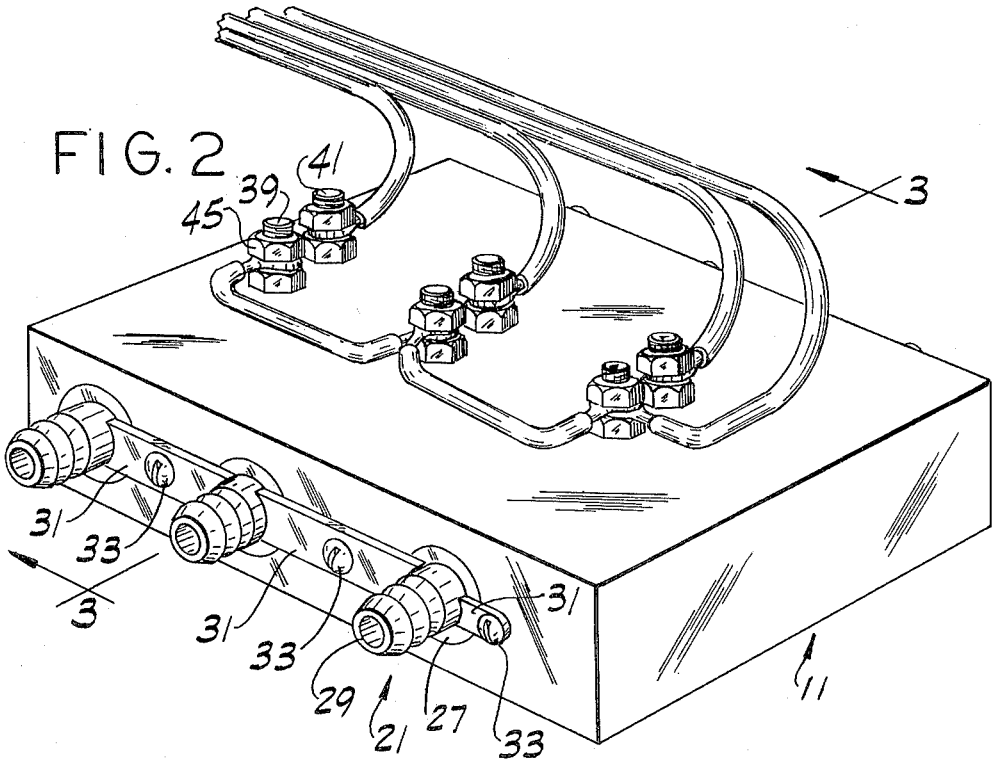
FIG. 2 is a perspective of the sensor body of FIG. 1.
Figure 3:
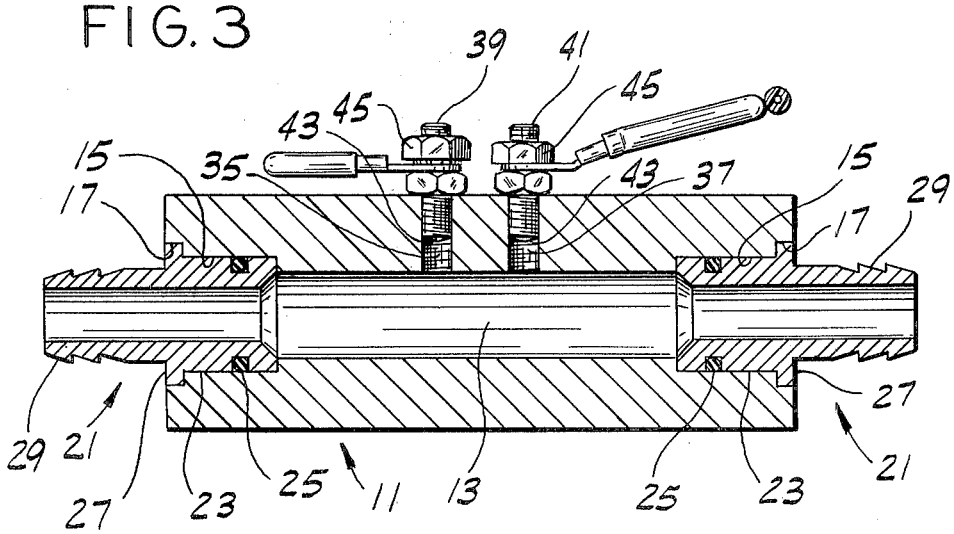
FIG. 3 is a section on line 3—3 of FIG. 2.

The signaling system comprises a sensor body or block, shown in detail in FIGS. 2 and 3 and designated in its entirety by the numeral 11, made of electrically non-conductive material such as transparent acrylic plastic. The body constitutes a fitting adapted to be mounted in the delivery lines 3 adjacent the containers 1 (FIG. 1), having three parallel cylindrical bores constituting passages 13 (see FIG. 3) therethrough for flow of beverage. Making the body of transparent plastic permits inspection of the passages. At the end of each passage, a small-diameter counterbore 15 extends inward to accept the inner end of a removable tubing connector 21, described below. A larger diameter counterbore 17 of lesser depth is also provided at each end of each passage, to accept a retaining flange on the connector.

Connectors 21 provide for connection of the delivery lines 3 to the outer ends of the passages. Each connector has an inner end 23 which is slideably fitted into the smaller counterbore 15, an O-ring 25 being provided to form a seal. A flange 27 on the connector seats in counterbore 17. At the outer end of the connector is a serrated stem 29 for application of the end of a length of tubing.

As shown in FIG. 2, retainers 31 for the connectors 21 are mounted on the outside of the body by screws 33 threaded in tapped holes in the body. The retainers extend over the flanges 27 to retain the connectors in place.

The connectors 21 constitute means at each end of each passage for connecting body 11 in one of the delivery lines for flow of beverage through the passage.

For each passage 13, two threaded bores 35, 37 extend laterally through the body into the passage, spaced from one another in the body in the direction of flow of the beverage through the passage in the body. For each passage, a set of two stainless steel probes 39, 41 is provided, each threaded adjacent its inner end for being threaded in one of the threaded bores through the body to the passage. The inner end of each probe is exposed to the beverage within the passage and constitutes an electrode 43. By the placement of the two threaded bores, the electrodes are spaced apart one from the other longitudinally in the passage for contact with beverage within the passage. The outer end of each probe has a nut 45 threaded thereon to serve as a terminal.

Figure 4:
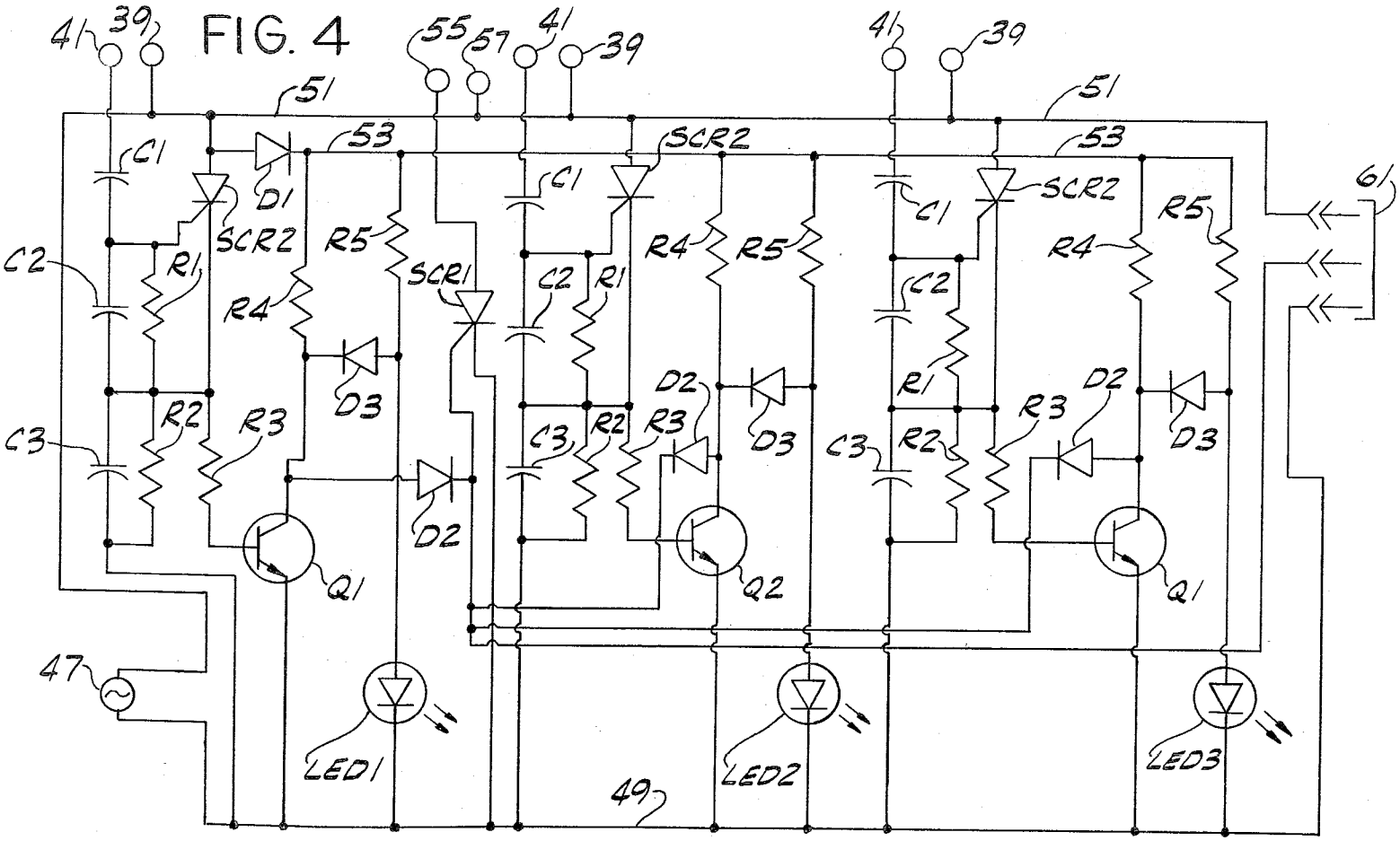
FIG. 4 is an electrical circuit diagram.

Sensing circuitry, shown in FIG. 4, determines whether beverage bridges the two electrodes, indicating whether the delivery line is full of beverage or whether a void is present at one or more of the electrodes. Such a void is an indication that the supply of beverage in the container 1 is depleted. The circuitry is driven by a 12 V alternating current supply 47, which is applied between a common line (common) 49 and probe supply line 51. A rectifier diode D1 connects to the probe supply line to provide a half-wave rectified line 53. A silicon-controlled rectifier SCR1 has its cathode connected to common 49 and its anode to an output terminal 55 for a common signaling device (not shown) for all three sets of probes. Another terminal 57 for the common signaling device is connected to the probe supply line 51. The remaining elements of the circuit form three identical subcircuits, one for each set of probes. Corresponding elements of the three subcircuits are correspondingly designated.

One probe 39 of each set is connected to the probe supply line 51, while the other probe 41 of each set is connected by a series combination of three capacitors C1, C2, C3 to common 49, with the probe to C1. A resistor R1 is in parallel with the center capacitor C2 of the series combination and another resistor R2 is in parallel with C3, which connects to common. A silicon controlled rectifier SCR2 has its anode connected to the probe supply line 51, its gate to the common terminal of C1, C2 and R1, and its cathode to the common terminal of C2, C3 and R2. The cathode is also connected by a base resistor R3 to the base of a transistor Q1, whose emitter is connected to common 49 and whose collector is connected by a load resistor R4 to the half-wave rectified line 53. The collector is tied to the gate of SCR1 by a diode D2, with the anode of D2 to the collector. Another diode D3 has its cathode connected to the collector and its anode to a resistor R5, which is connected to rectified line 53.

For each of the three subcircuits the common terminal of D3 and R5 is connected to the anode of one of three light-emitting diodes, the three being designated LED1, LED2, and LED3. The cathode of each LED is connected to common 49. The LEDs constitute means responsive to the sensing circuitry for visual signaling of non-bridging of the two electrodes (at the inner ends of the probes) by beverage in the line to signal emptying of container 1 to the attendant before any substantial amount of gas enters the delivery line from the empty container. The sensing circuitry and LEDs are mounted on a signaling panel 59 adjacent to dispensing valves 7 (see FIG. 1).

In the embodiment shown, the following circuit components are preferred:

| | | | |
|---|---|---|---|
| C1 | .22 microfarad | R5 | 510 ohm |
| C2 | .022 microfarad | D1 | IN 914 |
| C3 | .47 microfarad | D2 | IN 914 |
| R1 | 1.5 K ohm | D3 | IN 914 |
| R2 | 300 ohm | SCR1 | 2N5060 |
| R3 | 1 K ohm | SCR2 | 2N5060 |
| R4 | 1 K ohm | Q1 | 2N4123 |

As shown at the right side of FIG. 4, common line 49, probe supply line 51 and the gate of SCR1 are provided with outputs 61 for coupling to other identical sensing subcircuits.

In the use of the signaling system, body 11 is connected into the delivery lines, as near as is possible to containers 1, by connectors 21, as shown in FIG. 1. When the signaling system is to be installed in an existing beverage dispensing system, the lines may simply be cut and the resulting open ends connected at the opposite ends of a passage 13 in the body by the connectors, with the connectors secured in place by keepers 31. Signaling panel 59 is mounted adjacent the dispensing valves 7 and wiring from the body to the panel is installed.

When a container is not empty, the delivery line leading from it is filled with beverage. The two electrodes 43 at the inner ends of the probes 39, 41 are bridged by the beverage filling the line so that the series combination of capacitors C1, C2, and C3, as well as resistors R1 and R2, receive power. On the portion of the alternating current cycle when probe supply line 51 is positive (with respect to common 49), SCR2 conducts, causing Q1 to conduct and bypass the respective LED, keeping it off. On the opposite portion of the alternating current cycle when probe supply line 51 is negative, the LED and D1 are reverse-biased; thus the LED is off over the entire a.c. cycle. SCR1 is likewise nonconducting over the entire a.c. cycle.

When the beverage in a container is depleted, a void will soon reach one of the electrodes 43. Because the electrodes are then unbridged by the beverage, capacitors C1, C2 and C3 and resistors R1 and R2 no longer receive power from the supply 45 through the beverage and SCR2 becomes nonconducting. Since Q1 then becomes nonconducting, the LED is not bypassed and conducts on the portion of the a.c. cycle when probe supply line 51 is positive. Even though the LED is reverse-biased and nonconducting during the opposite negative portion of the a.c. cycle, since it is on during the positive portion it provides a signal that the beverage in the container is depleted. Likewise, SCR1 is forward-biased and conducting for half of each cycle, so that a common warning signal device connected to terminals 55 and 57 may be actuated.

When an empty container is signaled, the attendant may then replace the empty container with a full one by using the quick-disconnect coupling 5 in the delivery line upstream from body 11, which permits little or no air to enter the line while it is disconnected. Since the only portion of the line void of beverage is the relatively short length between the container and body, there is little disruption in the delivery of the beverage from the dispensing valve after the line is connected to the new full container.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A system for signaling emptying of any one of a plurality of beverage containers of a beverage dispensing system wherein beverage is dispensed from the containers through delivery lines each connected at one end to a container and each having a dispensing valve at its other end, beverage in each container being under pressure for delivery when a respective one of the valves is opened, beverage flowing directly from each container through the respective delivery line and out through the respective dispensing valve when the latter is opened, said delivery lines being relatively long and the valves being adjacent one another at a location relatively remote from the containers, said signaling system being adapted to signal the emptying of any one of the containers to an attendant operating the respective dispensing valve without any signal system components in the containers, before any substantial amount of gas enters the delivery line from the empty container, said signaling system comprising:

a body of electrically nonconductive material having a plurality of passages therethrough, one for each container, the body having means at each end of each passage for connecting each passage in a respective delivery line for flow of beverage through the passage;

a pair of electrically conductive probes extending through the body to each passage, the inner end of each probe being exposed to beverage in the passage to constitute an electrode, the electrodes being spaced one from the other longitudinally in the passage for contact with beverage within the passage;

a plurality of signals, one for each container, located adjacent the dispensing valves for signaling an attendant operating a dispensing valve while he is operating the valve that the respective container has been emptied so that he may shut off the dispensing valve before any substantial amount of gas enters the respective delivery line from the respective container, sensing circuit means for determining whether beverage bridges the two electrodes in each passage; and means responsive to the sensing circuit means for actuating each of said signals upon non-bridging of the two electrodes by beverage in the respective passage to signal the attendant operating the dispensing valve of the emptying of the respective container before any substantial amount of gas enters the respective delivery line from that container.

2. The signaling apparatus defined in claim 1 wherein each delivery line has a quick-disconnect coupling upstream from the body for connecting the line to the respective beverage container, each coupling being adapted to disconnect without admitting air into the delivery line.

3. The signaling apparatus defined in claim 1 wherein the body is of transparent plastic to permit inspection of each passage.

4. The signaling apparatus defined in claim 1 wherein each probe is threaded adjacent its inner end and the body has two threaded bores extending through the body into the passage to accept the threaded end of the probe.

5. The signaling apparatus defined in claim 1 wherein each signal is a light-emitting diode, the diodes being located adjacent the dispensing valves, the two electrodes in each passage are spaced from one another in the passage generally in the direction of flow of the beverage through the passage, each delivery line has a quick-disconnect coupling upstream from the body for connecting the line to the respective beverage container, each coupling being adapted to disconnect without admitting air into the delivery line, and the body is of transparent plastic to permit inspection of each passage.

* * * * *